US008549830B1

(12) United States Patent
Tao et al.

(10) Patent No.: US 8,549,830 B1
(45) Date of Patent: Oct. 8, 2013

(54) METHOD AND APPARATUS FOR IMPARTING FALSE TWIST TO YARN BEFORE RING SPINNING

(71) Applicant: The Hong Kong Polytechnic University, Hong Kong (CN)

(72) Inventors: Xiao Ming Tao, Hong Kong (CN); Bin Gang Xu, Hong Kong (CN); Tao Hua, Hong Kong (CN); Jie Feng, Hong Kong (CN); Heng Guo, Hong Kong (CN); Yunhui Jia, Hong Kong (CN)

(73) Assignee: Hong Kong Polytechnic University, Hong Hom, Kowloon, Hong Kong (CN)

( * ) Notice: Subject to any disclaimer, the term of this patent is extended or adjusted under 35 U.S.C. 154(b) by 0 days.

(21) Appl. No.: 13/747,679

(22) Filed: Jan. 23, 2013

Related U.S. Application Data

(60) Provisional application No. 61/616,198, filed on Mar. 27, 2012.

(51) Int. Cl.
*D01H 7/52* (2006.01)
*D01H 1/11* (2006.01)

(52) U.S. Cl.
USPC ..... 57/336; 57/75

(58) Field of Classification Search
USPC ..... 57/75, 336
See application file for complete search history.

(56) References Cited

U.S. PATENT DOCUMENTS 3,103,097 A * 9/1963 Meili et al. ..... 57/336
3,813,868 A * 6/1974 Lorenz ..... 57/336
3,910,025 A * 10/1975 Takai ..... 57/336
3,979,894 A 9/1976 Takai
4,027,467 A * 6/1977 Smith ..... 57/284
4,047,373 A * 9/1977 Takai ..... 57/336
4,248,038 A * 2/1981 Takai ..... 57/336
4,377,932 A * 3/1983 Dammann et al. ..... 57/336
4,402,179 A * 9/1983 Dammann et al. ..... 57/336
4,408,448 A * 10/1983 Bauer et al. ..... 57/336
4,429,524 A * 2/1984 Kress ..... 57/336
4,698,959 A * 10/1987 Schippers et al. ..... 57/336
5,966,918 A * 10/1999 Kino et al. ..... 57/264
6,006,508 A * 12/1999 Shigekawa ..... 57/338
2010/0024376 A1 2/2010 Tao et al.
2010/0175360 A1 7/2010 Lee
2012/0151894 A1* 6/2012 Tao et al. ..... 57/75

FOREIGN PATENT DOCUMENTS

WO WO 97/32064 A1 9/1997

OTHER PUBLICATIONS

State Intellectual Property Office of the People'S Republic of China, International Search Report in International Patent Application No. PCT/CN2013/073239 (Jun. 13, 2013).

* cited by examiner

*Primary Examiner* — Shaun R Hurley
(74) *Attorney, Agent, or Firm* — Leydig, Voit & Mayer, Ltd.

(57) ABSTRACT

A method and apparatus for imparting false twist to a short staple yarn delivered from a nip of a pair of front drafting rollers before ring spinning. Downstream of the nip, the twisted yarn is drawn sequentially across first and second runs of travelling endless belts, such that the yarn wraps about a first convex surface of the first run, then passes between the first and second runs, before wrapping about a second convex surface of the second run. Friction between each of the first and second convex surfaces and the yarn imparts the false twist in a common direction. Maintaining a differential between first and second linear speeds of the first and second runs, respectively, has been found to reduce yarn defects, particularly the nep count.

10 Claims, 5 Drawing Sheets

METHOD AND APPARATUS FOR IMPARTING FALSE TWIST TO YARN BEFORE RING SPINNING

TECHNICAL FIELD

The present invention relates to yarn manufacture by ring spinning, and more particularly to a method and apparatus for imparting false twist to a yarn delivered from a nip of a pair of front drafting rollers immediately before imparting real twist by ring spinning.

BACKGROUND OF THE INVENTION

The characteristics of ring spun yarn are unmatched by the products of other yarn spinning techniques which may be more productive, so it is a technology that is unlikely to be superseded in the near term. Much research has gone into ring spinning technology and relatively modest improvements to the productivity of a ring spinning frame can be very significant in a spinning mill where many thousands of spindles are employed. Many different raw material and machine-related factors directly influence both productivity and quality, and sometimes improvements in one area have consequences that necessitate a trade-off in another area. The goal of spinning technologists might therefore be considered a quest for an optimum balance between higher productivity and desired quality.

U.S. Pat. No. 3,979,894 describes a five-belt false twisting device for texturing filament yarn which, with its continuous lengths of filament, has quite different structure and properties to short staple ring spun yarn, and of course, it is not a ring spun yarn. Moreover, in this old false twisting device the filament yarn sequentially passes across parallel runs of five travelling endless belts, wrapping about convex surfaces of each run before passing between adjacent runs. Three of the belts turn in one direction, while two turn in an opposite direction, the filament yarn passing through the runs in a zig-zag manner such that friction between each of the five runs and the filament yarn imparts the false twist in a common direction. The belts are matched and all five belts travel at the same speed, to avoid twist variation that would lead to poor quality of the textured filament yarns and instability of the yarn path.

With respect to ring spinning technology, a more relevant apparatus is described in US2010/0024376, which teaches a single-belt method for imparting false twist to a yarn delivered from the nip of a pair of front drafting rollers immediately before ring spinning. The yarn received from the drafting rollers is drawn generally transversely and sequentially across first and second parallel runs of a single belt, passing about the first run, then between the runs, before passing about the second run. Friction between the first and second runs and the yarn imparts the false twist. The two runs of the belt move in opposite directions, but the linear speeds of the two runs are the same. Compared to conventional ring spinning, at a given production rate this single-belt false twist method produces yarns having lower residual torque which endows a resultant fabric with a softer handle, and it also provides satisfactory strength and reduced hairiness. The single belt can extend the length of a machine, making it a more cost-effective investment than alternative technologies involving heat treatment to reduce residual torque. However, it has been found that this single-belt technology results in an increase in yarn defects above the usual level—including the number of thick places, thin places and neps. A sharp increase in the number of neps is of particular concern, since neps can be a cause of ends down in downstream processing and they may not take up dye like the rest of the yarn, detracting from the appearance of the fabric. Achieving satisfactory nep counts therefore necessitates relatively higher maintenance costs to mitigate machine factors, such as wear, that are known to contribute to nep formation. It will therefore be understood, that a need exists for an improved false twist method and apparatus that is able to at least maintain the above-mentioned advantageous properties while reducing nep formation in ring spinning of short staple yarns. It is an object of the invention to address this need or, more generally, to provide an improved method of imparting false twist to yarn between drafting and ring spinning processes.

DISCLOSURE OF THE INVENTION

According to one aspect of the present invention there is provided a method of imparting false twist to a short staple yarn delivered from a nip of a pair of front drafting rollers before ring spinning, the method comprising drawing the yarn sequentially across first and second runs of travelling endless belts, such that the yarn exits from the nip and wraps about a first convex surface of the first run, then passes between the first and second runs, before wrapping about a second convex surface of the second run, whereby friction between each of the first and second convex surfaces and the yarn imparts the false twist in a common direction, and maintaining a differential between first and second linear speeds of the first and second runs respectively.

Experimental results have shown that, by maintaining the first and second runs at different speeds, a substantial reduction in the number of neps produced is achieved when compared to the single-belt false twisting method. It is to be understood that the direction of runs does not alter the differential between their linear speeds (hence the reference to speed—a scalar quantity), and while the respective directions of movement of the runs are preferably 180° apart, both runs can of course be aligned at other angles to one another so that both impart false twist to the yarn in a common direction. Also, while the differential, or non-zero difference in speeds, is preferably constant, it may be varied dynamically.

Preferably both the first and second runs are substantially parallel to the front drafting rollers and the yarn is drawn transversely across the first and second runs, and the differential is substantially constant when the front drafting rollers are rotated at a constant speed.

Preferably the first and second convex surfaces have the same radius of curvature, and most preferably the first and second belts are circular in cross-section. The firsthand second convex surfaces may subtend the same or different angles of wrap with the yarn.

Preferably the differential is such that the ratio of the first linear speed to a peripheral speed of the front drafting rollers is between 0.4 and 0.8, and a ratio of the second linear speed to the peripheral speed of the front drafting rollers is between 0.9 and 1.6.

Preferably twist applied to the yarn during ring spinning is in the same direction as the common direction of false twist.

Preferably the first run is disposed below the front drafting rollers and the second run is disposed below the first run. Preferably the first convex surface is aligned tangential to both of the front drafting rollers.

In another aspect the invention comprises apparatus for imparting false twist to a fibre bundle delivered from the nip of a pair of front drafting rollers before ring spinning the fibre bundle, the apparatus comprising first and second endless belts with first and second convex surfaces respectively, each of the first and second belts having a respective linear run, the linear runs being substantially parallel to one another such that the linear runs may be aligned parallel to the front drafting rollers, and drive means for driving the first and second endless belts at respective first and second different speeds.

Preferably the drive means comprises a controller operatively connected for controlling the speed of first and second variable speed motors connected for driving the first and second endless belts respectively.

This invention provides a method and apparatus which is effective and efficient in operational use, which reduces the nep count, and which has an overall simple and modular design which minimizes manufacturing costs and simplifies maintenance.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
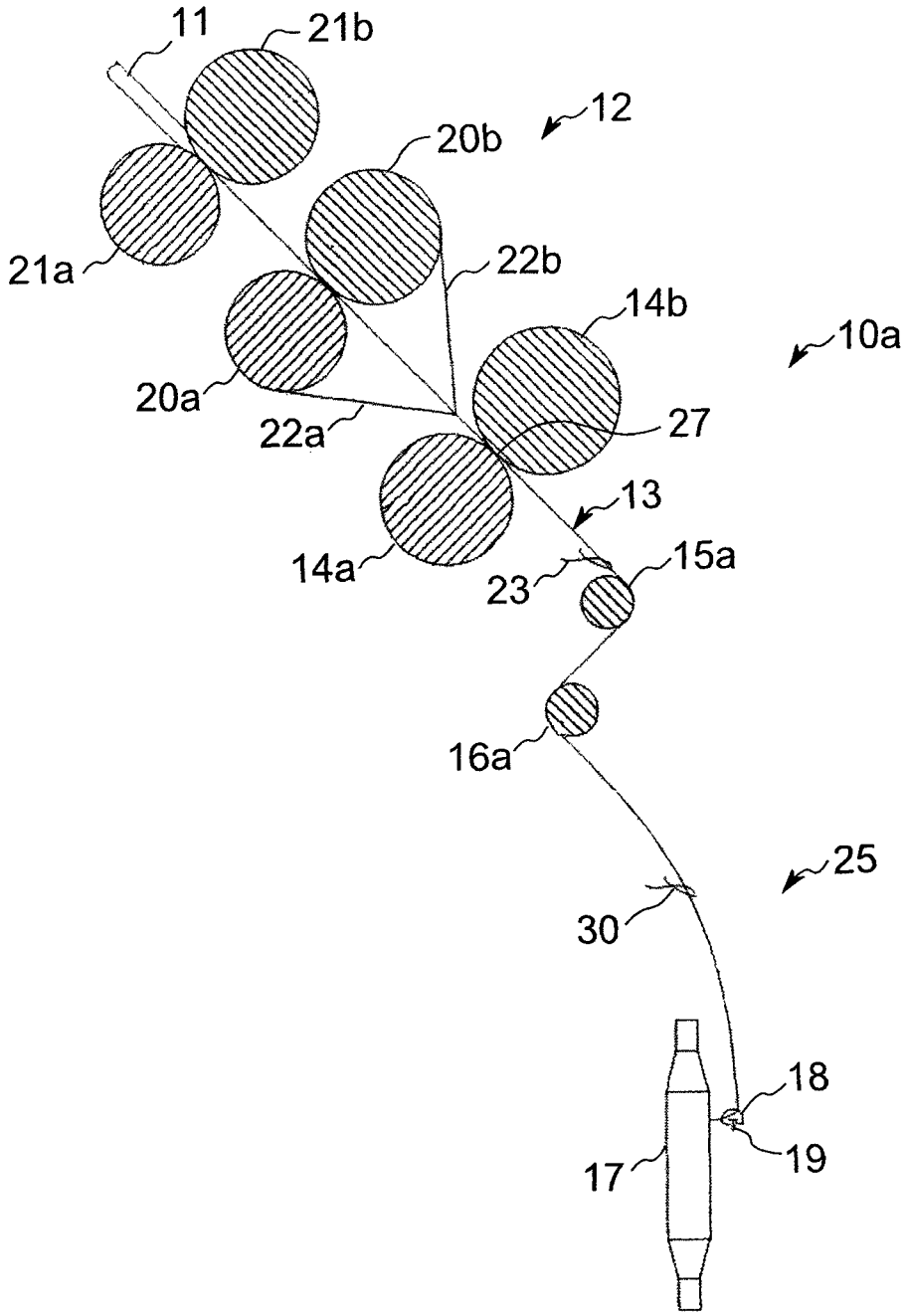
FIG. 1 is a schematic transverse section through a spinning apparatus according to a first embodiment of the invention.

In machines 10*a* and 10*b* (shown in FIGS. 1 and 5 respectively) for spinning short staple fibres (those less than 2 inches or approximately 50 mm in length), the roving 11 (the precursor to the yarn 13) is fed into a drafting system 12 where it is drawn to its final count. The exemplary drafting system 12 is shown at an angle of 45° to the horizontal and may comprise a six-roller, double-apron drafting system. After the resulting thin ribbon of fibres leaves the delivery or front rollers 14*a*, 14*b*, false twist is applied by the upper and lower linear runs 15*a*, 16*a* of two travelling endless belts 15, 16. The twist necessary for imparting strength is provided, in a direction opposite the false twist, by the take-up assembly 25 which also serves to draw the yarn 13 across the upper and lower linear runs 15*a*, 16*a*. The take-up assembly 25 is of conventional construction and includes the bobbin 17 rotating at high speed on a spindle. In the process each rotation of the traveller 18 on the spinning ring 19 produces a twist in the yarn. The traveller 18 is pulled with the bobbin 17 via the yarn 13 attached to it.

The drafting system 12 may be of six-roller, double-apron type illustrated, including three driven, bottom rollers 14*a*, 20*a*, 21*a* with top rollers 14*b*, 20*b*, 21*b* positioned above them, supported and pressed against bottom rollers 14*a*, 20*a*, 21*a*. The main drafting zone is provided with a guide unit consisting of rotating bottom and top aprons 22*a*, 22*b*. The back roller 21*a* has a prescribed rotational speed, and pinches the roving 11. The drawing speed of the roving 11 is determined by the peripheral speed of back roller 21*a*. In a similar manner, the apron roller 20*a* draws out roving 11. By adopting a drawing speed for apron roller 20*a* larger than the drawing speed of back roller 21*a*, the fibres of the roving 11 slide against each other and are formed into a fibre bundle finer than the roving 11, being made, for example, 1.5 to 2 times longer. In a similar manner, front roller 14*a* also draws out the fibre bundle fed from apron roller 20*a*. Its drawing speed is set to be greater than the drawing speed of apron roller 20*a*. For example, by setting the drawing speed to be twenty times faster than that of apron roller 20*a*, drafting will form a fibre bundle that is 20 times longer than the original.

Figure 2:
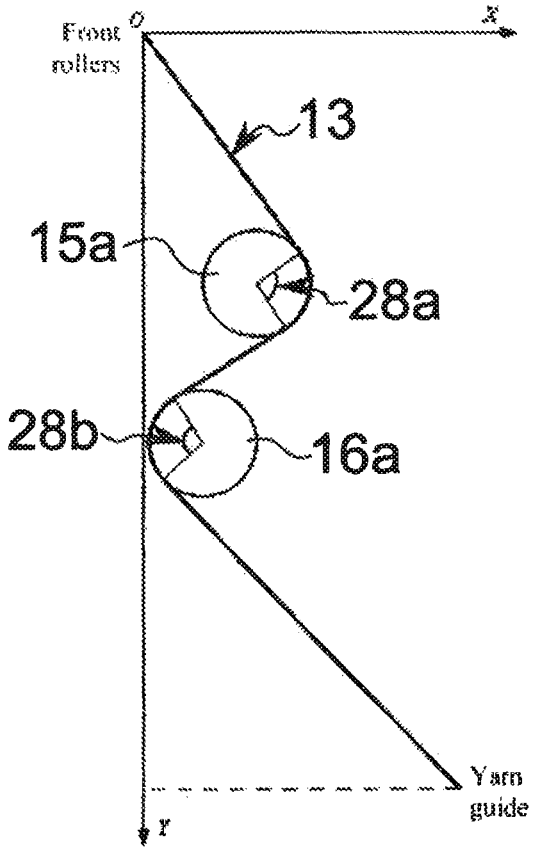
FIG. 2 is an enlarged schematic transverse section through of the false twisting belt device like that of FIG. 1, but showing an alternative geometry and wrap angles.

In the first embodiment of FIG. 1, the fibre bundle exits from the nip 27 between the front rollers 14*a*, 14*b* and extends to the point to which the twist is propagated from the belts 15, 16 (forming the so-called spinning triangle). Then yarn 13 passes through the fixed pigtail or yarn guide 23 then wraps about a first convex surface of the upper run 15*a*, then passes between the upper and lower runs, before wrapping about a second convex surface of the lower run 16*a*. The belts 15, 16 may be alike, having a circular cross section of the same diameter, such that the convex surfaces have the same radius of curvature. As shown in FIG. 2, the first convex surface is subtended at the central axis of the upper run 15*a* by an angle of wrap 28*a*. The second convex surface is subtended at the central axis of the lower run 16*a* by an angle of wrap 28*b*. The angles of wrap 28*a*, 28*b* may vary between the upper and lower runs 15*a*, 16*a* and for the geometry shown, where the upper and lower runs 15*a*, 16*a* contact opposing sides of the tarn 13 and move in opposite directions, the angles of wrap 28*a*, 28*b* may be approximately 80-110°. The yarn 13 may extend at the same angle to the horizontal as the drafting system 12, passing between the front rollers 14*a*, 14*b* and the upper run 15*a*, tangentially to both the front rollers 14*a*, 14*b* and the convex surface of the upper run 15*a*. The yarn 13 may pass generally in a line from the lower run 16*a* to a fixed pigtail or yarn guide 30, before passing to the take-up assembly 25. The yarn is then reverse twisted as a result of the true twist propagated from the traveller 18, forming the final yarn.

Figure 3:
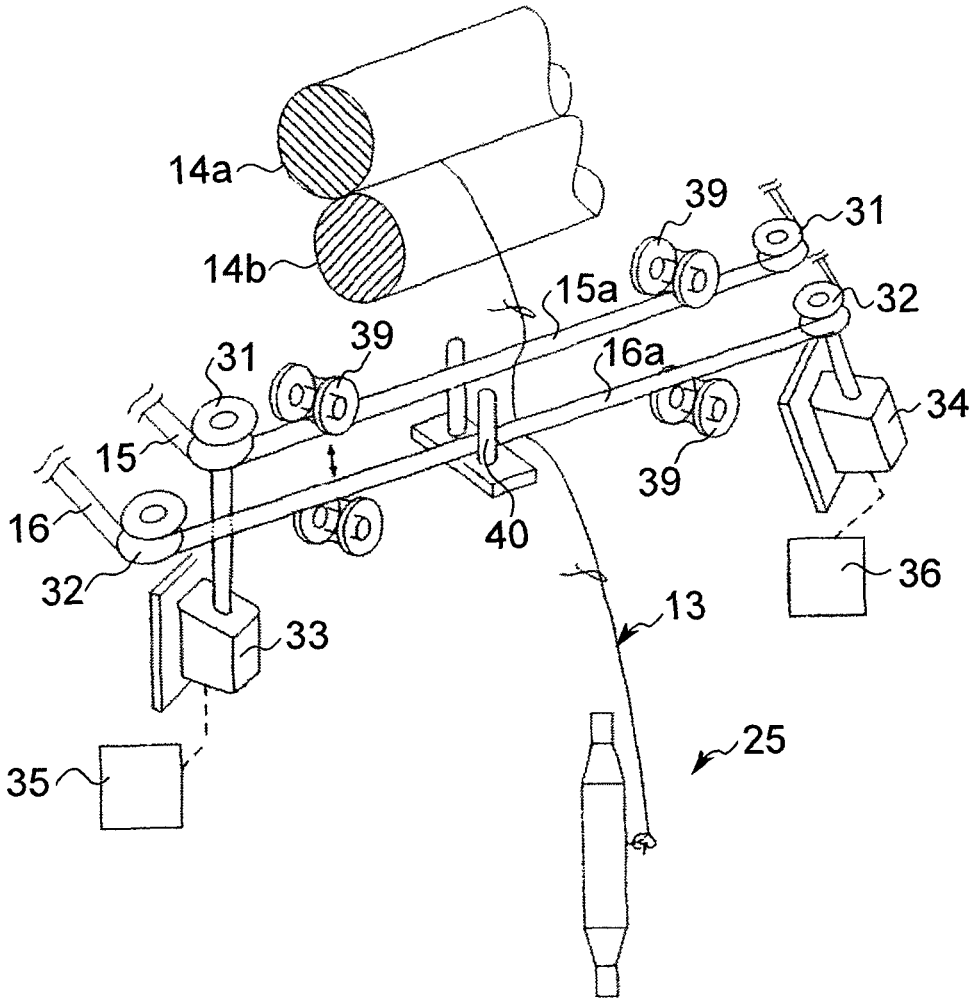
FIG. 3 is a schematic perspective view of the spinning device of FIG. 1.

FIG. 3 shows the upper and lower runs 15*a*, 16*a* extending linearly and parallel to one another between respective pairs of pulleys 31/31, 32/32 mounted to rotate about upright axes at opposite ends of the runs. The belts 15, 16 may be driven by variable speed rotary motors driving the pulleys 31, 32, such as AC motors 33, 34 with respective inverter-type speed controls 35, 36, or DC servomotors or stepper motors (not shown). This allows the belts 15, 16 to be driven at different speeds so as to maintain the differential between the linear speeds of the upper and lower runs 15*a*, 16*a*. The upper and lower runs 15*a*, 16*a* preferably extend for the full length of the machine (i.e. up to around 50 m in large machines) so additional support pulleys or rollers 39 and guides 40 may be provided at intermediate positions to support the weight of the belts 15, 16 and ensure their proper alignment.

Figure 4:
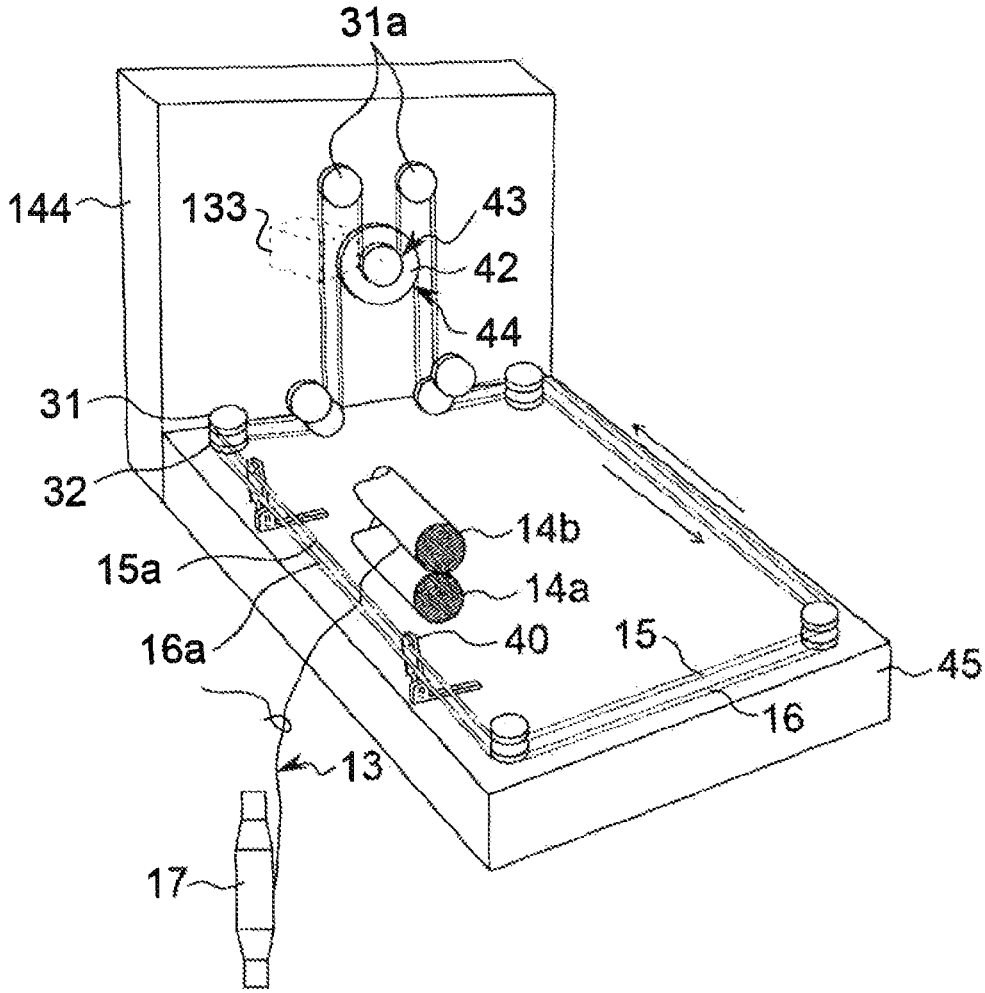
FIG. 4 is a schematic perspective view of a single-motor variant of the spinning device of FIG. 1.

As illustrated in FIG. 4, in a variation of the first embodiment of FIGS. 1-3, instead of two different motors, a single rotary motor 133 is provided for driving both belts 15, 16 via a wheel 42 having a small diameter portion 43 about which the lower belt 16 is wrapped, and a large diameter portion 44 about which the upper belt 15 is wrapped. The motor 133 and wheel 42 may be provided, along with other transmission, electrical and electronic components in one of the end stocks 144 and the belts 15, 16 may extend parallel to one another generally about the periphery of an elongate frame member 45. In this manner the ratio of the diameters of the portions 43, 44 defines the differential between the linear speeds of the upper and lower runs 15*a*, 16*a*. The idler pulleys 31*a* on either side of the wheel 42 provide a direction change, so that the upper and lower runs 15*a*, 16*a* move in opposite directions. By moving in opposite directions, and engaging opposing sides of the yarn, both the upper and lower linear runs 15*a*, 16*a* cooperate to impart the false twist in a common direction.

Figure 5:
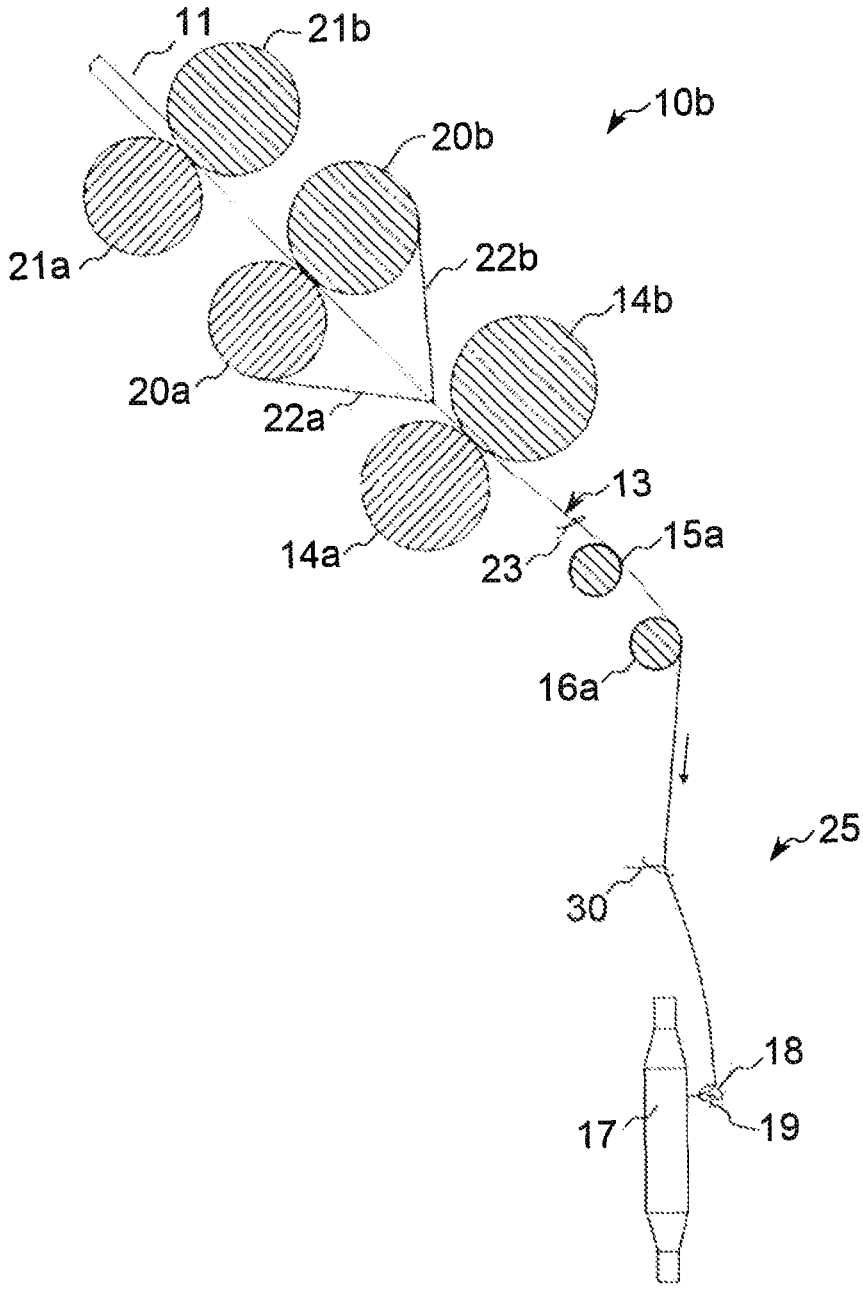
FIG. 5 is a schematic transverse section through a spinning apparatus according to a second embodiment of the invention.

As shown in FIG. 5, in the second embodiment the upper and lower linear runs 15*a*, 16*a* may alternatively engage on the same side of the yarn 13, in which case they are driven in the same direction to impart the false twist in a common direction. As in the first embodiment, the belts 15, 16 may be alike, having a circular cross section of the same diameter, such that the convex surfaces have the same radius of curvature. Alternatively, the belts may have convex surfaces having different radius of curvature which are in contact with the yarn. The first convex surface is subtended at the central axis of the upper run 15*a* by an angle of wrap (of approximately 5°) which is smaller than the angle of wrap subtended by the second convex surface at the central axis of the lower run 16*a* (which may be of approximately 20°). The yarn 13 may be deflected from the angle of 45° to the horizontal of the drafting system 12, having a larger angle of wrap about front roller 14*b* than about front roller 14*a*.

Experimental results shown in the tables below demonstrate that, compared to the single-belt method for imparting false twist (as described in US2010/0024376) by maintaining the differential such that the ratio of the first linear speed of the upper run 15*a* to a peripheral speed of the front drafting rollers is 0.5, and the ratio of the second linear speed of the lower run 16*a* to the peripheral speed of the front drafting rollers is 1.0 a reduction in neps to a level comparable to that of conventional ring spun yarn (without the false twisting stage between drafting and take-up) is achieved, while breaking strength is increased with lower twist, hairiness (s3) is reduced and evenness is substantially unaffected.

In each one of four sets of tests performed, a cotton yarn of different yarn count was spun and the properties of the yarn resulting from three different spinning methods were measured. The results for each of the four sets of tests are presented in the Tables 1-4 below.

Method/Apparatus 1—Conventional

The yarns were spun firstly on a conventional ring spinning frame without false twisting.

Method/Apparatus 2—Single-Belt

In the second test the same conventional spinning frame was modified to include a single-belt false twisting device as described in US2010/0024376 between the drafting system 12 and take-up assembly 25. A circular cross-section belt of 4 mm diameter and made from polyurethane was maintained at a speed of 50% of the peripheral speed of the front rollers 14*a*, 14*b*.

Method/Apparatus 3—Invention

In the third test the same spinning frame was modified to include the two-belt differential speed arrangement described and illustrated above with respect to the first embodiment of FIGS. 1-3. Two like circular cross-section belts of 4 mm diameter and made from polyurethane were employed. The ratio of the first linear speed of the upper run 15*a* to a peripheral speed of the front drafting rollers was maintained at 0.5, and the ratio of the second linear speed of the lower run 16*a* to the peripheral speed of the front drafting rollers was maintained at 1.0.

TABLE 1

40s yarn count and spindle speed of 16000 rev/minute.

| Method/ Apparatus | Evenness CVm(%) | +200% Neps (/1000m) | Twist (turns/ inch) | Breaking Strength (cN) | S3 (/10m) |
|---|---|---|---|---|---|
| 1 - Conventional | 12.79 | 33 | 25.5 | 291.5 | 151 |
| 2 - Single-belt | 12.58 | 86 | 23 | 285.8 | 69 |
| 3 - Invention | 12.76 | 39 | 23 | 286.2 | 65 |

TABLE 2

50s yarn count and spindle speed of 16000 rev/minute

| Method/ Apparatus | Evenness CVm(%) | +200% Neps (/1000m) | Twist (turns/ inch) | Breaking Strength (cN) | S3 (/10m) |
|---|---|---|---|---|---|
| 1 - Conventional | 12.14 | 35 | 25 | 325.6 | 147 |
| 2 - Single-belt | 12.34 | 107 | 21 | 305.1 | 118 |
| 3 - Invention | 12.23 | 38 | 21 | 310.2 | 83 |

TABLE 3

80s yarn count and spindle speed of 15000 rev/minute.

| Method/ Apparatus | Evenness CVm(%) | +200% Neps (/1000m) | Twist (turns/ inch) | Breaking Strength (cN) | S3 (/10m) |
|---|---|---|---|---|---|
| 1 - Conventional | 14.55 | 80 | 32.3 | 184 | 164 |
| 2 - Single-belt | 15.17 | 452 | 27.4 | 176.2 | 102 |
| 3 - Invention | 15.01 | 85 | 27.4 | 180.5 | 88 |

TABLE 4

100s yarn count and spindle speed of 15000 rev/minute.

| Method/ Apparatus | Evenness CVm(%) | +200% Neps (/1000m) | Twist (turns/ inch) | Breaking Strength (cN) | S3 (/10m) |
|---|---|---|---|---|---|
| 1 - Conventional | 15.14 | 135 | 39 | 142.1 | 157 |
| 2 - Single-belt | 15.91 | 676 | 33 | 135.8 | 99 |
| 3 - Invention | 15.57 | 142 | 33 | 138.4 | 89 |

The optimum differential in speeds between the upper and lower runs may vary depending upon the yarn being processed. Further experimentation suggests that a worthwhile improvement, compared to yarn produced by the single-belt method, can be achieved by maintaining the differential such that the ratio of the first linear speed to a peripheral speed of the front drafting rollers is between 0.4 and 0.8, and a ratio of the second linear speed to the peripheral speed of the front drafting rollers is between 0.9 and 1.6.

While the significant reduction in the nep count achieved by the invention was unexpected and the precise mechanism by which it is achieved remains unclear, it is believed, without wishing to be limited by theory, that the advantage of driving the upper run 15*a* relatively slower than the lower run 16*a* may be two-fold. One factor is the reduction the twist propagated toward the nip 27 that may reduce the chance of wrapping by protruding fibre ends because relative movement of the surface fibres and core fibres are smaller. The second factor is the ability to reduce untwisting after the upper run 15*a*, so as to reduce the possibilities for loose fibres rubbing off the yarn surface. The combination of these factors is believed to contribute to the significant reduction of neps.

The frictional forces at the interface between the belts 15, 16 and the yarn 13 achieve the false twisting action, so the factors influencing these frictional forces may be varied to allow satisfactory false twist to be imparted to yarns of different materials and yarn counts. The primary factors influencing friction are yarn tension and belt material and surface finish. By supporting the upper and lower runs 15*a*, 16*a* in pulleys which can be axially displaced along upright axles, the spacing between the runs, and between the upper run 15*a* and drafting rollers 14*a*, 14*b*, can be readily adjusted, to vary the angle of wrap and therefore the yarn tension. A coefficient of friction between the belts 15, 16 and the yarn 13 of between 0.5 and 0.8 is satisfactory, and this may be readily achieved with commercially available reinforced or unreinforced belts made of polyurethane, polyethylene, synthetic rubber and polyester, or the like.

Compared to yarns produced by conventional ring spinning without false twisting, the method of the invention allows yarns to be spun with similar levels of defects, particularly neps, but with higher tenacity, lower hairiness and a lower twist level. High quality fabrics with a soft handle and smooth surface can be produced from these yarns. Other advantages of the invention are that the two belts 15, 16 can be economically installed and maintained in a long machine. The provision of separately mounted and tensioned belts makes the apparatus less susceptible belt tension variations adversely affecting both runs simultaneously. A reduction in ends down frequency in downstream processing can be expected, owing to the reduced nep count.

Aspects of the present invention have been described by way of example only and it should be appreciated that modifications and additions may be made thereto without departing from the scope thereof.

The invention claimed is:

1. A method of imparting a false twist to a short staple yarn delivered from a nip of two front drafting rollers, before ring spinning of the yarn, the method comprising:

drawing the yarn sequentially across first and second runs of travelling endless belts, such that the yarn sequentially exits from the nip and wraps about a first convex surface of the first run, then passes between the first and second runs, and thereafter wraps about a second convex surface of the second run, whereby friction between the yarn and each of the first and second convex surfaces applies a respective torque to the yarn, each torque tending to twist the yarn in a common direction, and maintaining the first and second runs at different respective first and second linear speeds.

2. The method of claim 1 wherein both the first and second runs are substantially parallel to the two front drafting rollers, and the yarn is drawn transversely across the first and second runs, and further including maintaining a substantially constant difference between the first and second linear speeds of the first and second runs when the two front drafting rollers are rotated at a constant speed.

3. The method of claim 1 wherein the first and second convex surfaces have the same radius of curvature.

4. The method of claim 3 wherein the endless belts are circular in cross-section.

5. The method of claim 1 wherein the difference between the first and second linear speeds of the first and second runs is maintained such that a ratio of the first linear speed to a peripheral speed of the two front drafting rollers is between 0.4 and 0.8, and a ratio of the second linear speed to the peripheral speed of the front drafting rollers is between 0.9 and 1.6.

6. The method of claim 1, including ring spinning the yarn after imparting the false twist to the yarn and, during the ring spinning, applying a twist to the yarn in the common direction of the respective torques applied by the first and second runs.

7. The method of claim 1 wherein the first run is disposed below the two front drafting rollers and the second run is disposed below the first run.

8. An apparatus for imparting a false twist to a fibre bundle delivered from the nip of a pair of front drafting rollers before ring spinning the fibre bundle, the apparatus comprising:

first and second endless belts with first and second convex surfaces, respectively, each of the first and second endless belts having a respective linear run, the linear runs being substantially parallel to one another such that the linear runs may be aligned parallel to the pair of front drafting rollers, and drive means for driving the first and second endless belts at respective, different first and second speeds.

9. The apparatus of claim 8 wherein the drive means comprises a controller operatively connected for controlling speeds of first and second variable speed motors connected for driving the first and second endless belts, respectively.

10. A ring spinning frame comprising the apparatus of claim 8 disposed between a drafting system and a take-up assembly.

* * * * *